US010212500B2

(12) United States Patent
Hogan et al.

(10) Patent No.: US 10,212,500 B2
(45) Date of Patent: Feb. 19, 2019

(54) DIGITAL TRANSDUCER CIRCUIT

(71) Applicant: Apple Inc., Cupertino, CA (US)

(72) Inventors: Roderick B. Hogan, San Francisco, CA (US); Girault W. Jones, Los Gatos, CA (US); Nathan A. Johanningsmeier, San Jose, CA (US)

(73) Assignee: Apple Inc., Cupertino, CA (US)

( * ) Notice: Subject to any disclaimer, the term of this patent is extended or adjusted under 35 U.S.C. 154(b) by 7 days.

(21) Appl. No.: 15/418,395

(22) Filed: Jan. 27, 2017

(65) Prior Publication Data

US 2018/0220214 A1 Aug. 2, 2018

(51) Int. Cl.
*H04R 3/00* (2006.01)
*H04R 1/04* (2006.01)

(52) U.S. Cl.
CPC ..... *H04R 1/04* (2013.01); *H04R 3/007* (2013.01)

(58) Field of Classification Search
CPC ..... H04R 3/00
See application file for complete search history.

(56) References Cited

U.S. PATENT DOCUMENTS 7,292,876 B2 11/2007 Bosch et al.
7,940,942 B2 5/2011 Little
8,649,534 B2 2/2014 Wu
8,842,863 B2 9/2014 Nielsen et al.
8,923,542 B2 12/2014 Kilsgaard et al.
9,338,550 B2 5/2016 Froemel
9,343,976 B2 * 5/2016 Chu ..... H02M 3/33507
2010/0013501 A1 * 1/2010 Van Den Boom ..... G01D 3/08 324/679
2013/0106377 A1 * 5/2013 Lee ..... H02M 3/157 323/282
2015/0125004 A1 5/2015 Cagdaser et al.
2016/0065231 A1 * 3/2016 Gonen ..... H03M 1/14 341/156
2016/0149586 A1 * 5/2016 Roh ..... H03M 3/39 341/143
2017/0023429 A1 * 1/2017 Straeussnigg ..... H03M 3/336
2017/0099011 A1 * 4/2017 Freeman ..... H02M 7/06
2017/0142519 A1 * 5/2017 Lasseuguette ..... G10L 19/22
2017/0222655 A1 * 8/2017 Aoki ..... H03L 7/26
2018/0077504 A1 * 3/2018 Shaquer ..... H04R 25/604
2018/0081416 A1 * 3/2018 Larosa ..... G06F 1/3206

OTHER PUBLICATIONS

"Programmable Resolution 1—Wire Digital Thermometer", *Maxim Integrated*, 19-7487; Rev. 4, (Jan. 2015), 20 pages.
Van Rhijn, Arie, "Digital Microphones—Applications and System Partitioning", *LM4665, LMV1012, Texas Instruments*, (2011), 7 pages.

* cited by examiner

*Primary Examiner* — Olisa Anwah
(74) *Attorney, Agent, or Firm* — Womble Bond Dickinson (US) LLP

(57) ABSTRACT

An analog to digital conversion circuit receives a transducer output signal and outputs a data bitstream, where a latch or flip flop has an input that receives a clock signal. An AC-DC power converter receives the clock signal and produces a DC voltage which may power the analog to digital conversion circuit. The AC-DC power converter has a rectifier, an energy store and a voltage regulator, charge pump or filter, which draws power from the energy store to produce the DC voltage. A control circuit delays replenishment of the energy store by the rectified clock signal, responsive to the clock signal. Other embodiments are also described and claimed.

22 Claims, 3 Drawing Sheets

DIGITAL TRANSDUCER CIRCUIT

FIELD

An embodiment of the invention is directed to a digital microphone integrated circuit that may be packaged in a 3-pin or 4-pin package. Other embodiments are also described.

BACKGROUND

A conventional, digital acoustic microphone integrated circuit package produces as its output a pulse density modulated audio data stream, in accordance with an input clock signal generated external to the integrated circuit package. The addition of an input power supply pin and a power supply return or ground pin will increase the pin count of the package to at least 4 pins. In order to allow two identical ones of such a package to share a single, time division multiplexed bus, for example in applications that need multiple acoustic microphones operating simultaneously, the microphone integrated circuit also has an address section which receives an external address signal that is used to specify which integrated circuit should send its data during a high phase of the clock signal and which should send its data during the low phase of the clock signal. This brings the pin count in the latter application to at least 5 pins. Some applications however are constrained in either the pin count of the digital microphone integrated circuit package itself, or in cabling, connector routing or a printed circuit board/flex connections to the package, such that a reduced pin-count digital microphone integrated circuit package would be desirable.

SUMMARY

An embodiment of the invention is a digital transducer circuit that may be packaged in a 3-pin integrated circuit package, or in a 4-pin package (where in the latter case an external address signal is also needed to support the operation of several replicates of the transducer circuit simultaneously on the same time division multiplexed bus). The digital transducer circuit has an analog to digital conversion circuit whose input receives a transducer output signal, and whose output produces a transducer data bitstream. The conversion circuit has a latch or flip-flop having an input that receives the externally produced clock signal. An AC-DC power converter has a power supply input to receive the clock signal, and a power supply output that produces a DC voltage which may power the conversion circuit. The power converter has a rectifier to rectify the clock signal, an energy store that is replenished by the rectified clock signal, and a voltage regulator, charge pump, or filter that draws power from the store device to produce the DC voltage. A control circuit is configured to delay replenishment of the energy store by the rectified clock signal, responsive to the clock signal. This design needs only three pins in its integrated circuit package, e.g., a clock pin, a data pin, and a ground pin.

In addition, the above design mitigates distortion of the clock signal. For example, consider the case where the rising edge of the clock signal is used by the analog to digital conversion circuit for timing purposes. The additional loading on the clock signal caused by the rectified clock signal replenishing the energy store will alter or distort the otherwise precise characteristics of the clock rising edge. In other words, harvesting energy from the clock signal (to replenish the energy storage) will change the shape of the rising edge of the clock signal, which could adversely affect timing in the analog to digital conversion circuit. To prevent this, the control block delays the replenishment, responsive to the clock signal, so that replenishment does not start until after a logic level threshold of the clock signal has propagated into the latch or flip flop of the analog to digital conversion circuit. This ensures that the timing goal of the clock signal is not disturbed by the multi-purpose usage of the clock signal as a rectified clock signal (that replenishes the energy store).

In another embodiment, in the interest of reducing the size of the energy store, the analog to digital conversion circuit is configured to drive the transducer bitstream at its output during the high voltage phase but not during the low voltage phase of the clock signal. This aspect can mitigate the severity of the depletion of the energy store in cases where a data line (on which the transducer bitstream is being driven) has significant capacitance (such that a substantial amount of the stored energy would be taken to charge the data line during a low to high transition in the bitstream). By driving the data line (low to high transitions) only during the high voltage phase of the clock signal, the energy needed to charge the data line can be sourced simultaneously by the rectified clock signal and as supplemented by the energy store, thereby helping reduce the size of the energy store required.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
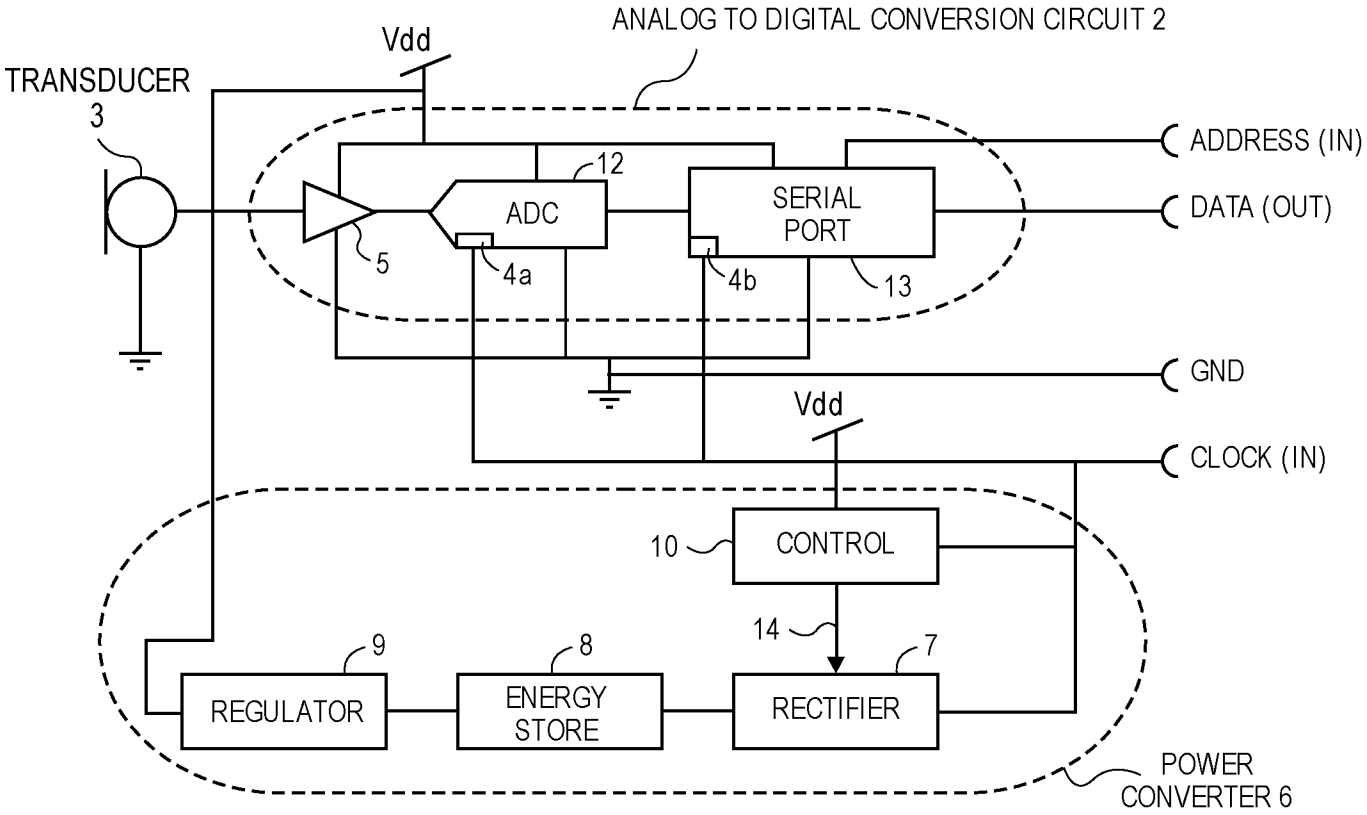
FIG. 1 is a combined circuit schematic and block diagram of an embodiment of a digital transducer circuit.

FIG. 1 is a combined circuit schematic and block diagram of a digital transducer circuit. An analog to digital conversion circuit 2 has an input to receive a transducer output signal from a transducer 3, and an output that produces a transducer data bitstream also referred to as data (out). The transducer 3 may be an acoustic microphone or it may be another sensor or transducer such as an accelerometer. The transducer output signal which may be in analog form is converted into digital form, as a data bitstream on a single wire or pin of an integrated circuit package (not shown) in which all of the elements shown in FIG. 1 may be contained. To do so, the analog to digital conversion circuit 2 may have a latch or flip flop 4*a* or 4*b* having an input that receives a clock signal, also referred to as clock (in). In the particular example shown in FIG. 1, the clock signal is fed to a latch or flip flop 4*a* that is part of an analog to digital converter (ADC) 12, and to a latch or flip flop 4*b* that is part of a serial port 13 (the latter also referred to here as a pulse modulator). In other words, the conversion circuit 2 uses a rising edge or a falling edge (or both) of the clock signal for purposes of timing, in order to produce the transducer data bitstream. The input to the ADC 12 may be from a pre-amplifier 5 which may serve to amplify or raise the analog sensor or transducer level at the output of the transducer 3.

The serial port circuit 13 serves to reformat a digitized version of the transducer signal (the latter provided by the ADC 12) into a bitstream, for example as would be performed by a pulse modulator such as a pulse density modulation (PDM) modulator. The pulse modulator translates raw digital values from the ADC 12 into an output pulse code or pulse density modulation bitstream. Other types of serial ports are possible including different types of pulse modulators, such as a pulse code modulation (PCM) modulator.

More generally, the combination of the pre-amplifier 5, ADC 12 and serial port 13 may be replaced with an equivalent form of analog to digital conversion circuitry, such as a sigma delta modulator. In one embodiment, the clock signal may be a square wave having a 50% duty cycle and a voltage swing from zero volts (ground) to some positive peak voltage. It may, for example have a fundamental clock frequency in the range 750 kHz to 6 MHz. Alternatively, a sine wave may be used, as well as a fundamental clock frequency that is in a different range which is deemed to be sufficiently high as to enable sampling of the analog transducer output signal and meeting the speed needed to produce the output data bitstream.

The embodiment in FIG. 1 also depicts the use of an external address signal referred to as address (in) which may be generated externally to the transducer circuit and serves to indicate when the particular transducer circuit shown in FIG. 1 is to drive a shared (or time division multiplexed) data bus. For example, if there are two or more replicates of such transducer circuits, each would drive its respective data (out) signal on the same, single, serial communications bus wire but in different time slots. In one embodiment, there may be two such transducer circuits (e.g., replicates of the design in FIG. 1), for example a left microphone circuit and a right microphone circuit that produce a left microphone pickup signal and a right microphone pickup signal respectively, where for example the left microphone bitstream is driven only in the high phase of the clock signal while the right microphone signal is driven only in the low phase of the clock signal as indicated by the address (in) signal. In one embodiment, each cycle of the clock signal has a single high phase and a single low phase, and a single bit is driven in each phase. In other embodiments, multiple bits may be driven in each phase, to make more efficient use of the time multiplexed data bus.

Still referring to FIG. 1, the digital transducer circuit also has an AC-DC power converter 6 that serves to produce a DC voltage Vdd which is used by or powers the analog to digital conversion circuit 2. A rectifier 7 rectifies the clock signal at its output, which is coupled to an energy store 8 which is replenished by the rectified clock signal. The energy store 8 may be a capacitor, an inductor, or a combination thereof, for example. The rectifier 7 also serves to avoid depletion of the energy store 8 back through the rectifier 7 and through the clock signal line, during the low phase of the clock. A voltage regulator 9 draws power from the energy store 8 and produces Vdd. An alternative to the voltage regulator 9 is a charge pump, a passive filter, or any combination thereof. This is also referred to as a shared Vdd/clock approach for providing, from the same external pin or wire, both a power supply to a digital transducer circuit as well as a clock that is used for purposes of timing by the transducer circuit that is producing an output data bitstream.

As mentioned above, using the clock signal to directly replenish the energy store 8 in this manner may alter the characteristics of the rising and also perhaps the falling edge of the clock signal, thereby impacting the timing within the analog to digital conversion circuit 2 which relies upon for example the rising edge and/or falling edge of the clock signal. To mitigate the effect on timing of distortion of the clock signal edges, a control circuit 10 is provided that is configured to delay replenishment of the energy store 8 (by the rectified clock signal), responsive to the clock signal. For example, the replenishing that occurs in each cycle of the clock signal is controlled, so that replenishment does not start until after a logic level threshold of the clock signal has propagated through the latch or flip flop 4*a*, 4*b* of the analog to digital conversion circuit 2. In other words, the replenishment is delayed until after the "timing task" of the clock edge has been completed. The control circuit 10 may produce a charge enable signal 14 that serves to signal the rectifier 7 to begin using the clock signal for purposes of replenishing the energy store 8 (by rectifying the clock signal). The charge enable signal 14, when asserted, indicates that the energy store 8 be replenished by the rectified clock signal. When de-asserted, it indicates that the energy store not be replenished (through the power supply input of the AC-DC power converter that receives the clock (in)), effectively de-coupling the clock (in) from the energy store 8, to ensure that the timing task of clock(in) is completed while the clock edge is not distorted (due to loading by the energy store 8). Several possibilities for the control circuit 10 are now described.

Figure 2:
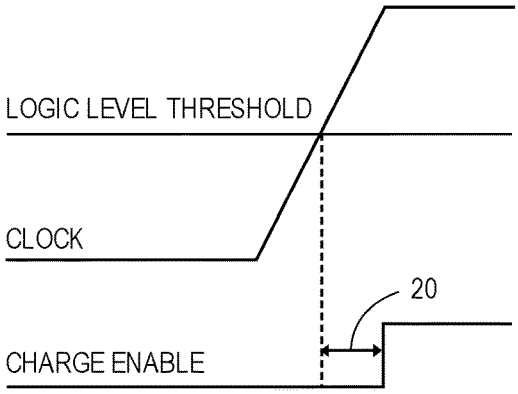
FIG. 2 shows clock and charge enable waveforms for an embodiment in which the control circuit has a digital delay circuit that achieves the replenishment delay.

FIG. 2 shows clock and charge enable waveforms for an embodiment in which the control circuit 10 has a digital delay circuit that achieves the replenishment delay. The clock signal may have a 50% duty cycle, and may be a square wave as shown, having a high voltage phase and a low voltage phase, and where by virtue of the rectification and the voltage swing from zero to some positive level, the energy store 8 is replenished during the high phase of the clock (and not during the low phase).

In FIG. 2, the control of the replenishing is based on delaying a rising edge of the clock, in order to trigger the start of the replenishment. A delay 20 is obtained by suitably configuring a digital delay circuit that delays its input by for example a predetermined time interval, and where the input receives or is derived from the clock signal. Accordingly, as shown in FIG. 2, the output, referred to as the charge enable signal 14 (see FIG. 1), becomes asserted in response to being triggered by the clock reaching its logic level threshold, following the delay 20. The delay 20 ensures that the rising edge of the clock is not disturbed or altered due to loading by the energy store 8, so that the clock edge can be simultaneously used for purposes of timing by the analog to digital conversion circuit 2.

Figure 3:
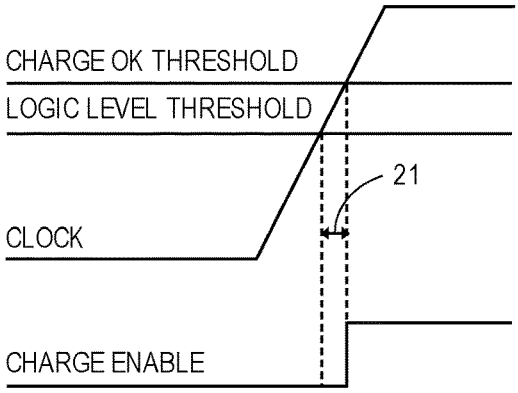
FIG. 3 shows clock and charge enable waveforms for an embodiment where the control circuit has a voltage comparator that achieves the replenishment delay based on voltage threshold detection.

In another embodiment, referring now to FIG. 3, the charge enable signal 14 is produced by the control circuit 10, using a voltage comparator that achieves a replenishment delay 21 which is based on voltage threshold detection. In other words, a voltage comparator (not shown) as part of the control circuit 10 detects that the clock has reached a predetermined voltage threshold that is referred to in FIG. 3 as "charge ok threshold" and in response triggers the assertion of the charge enable signal 14 as shown. This results in the delay 21 being created, between the point in time in which the clock reaches its logic level threshold and the subsequent point in time (in the same cycle of the clock) at which the charge enable signal 14 is asserted.

Figure 4:
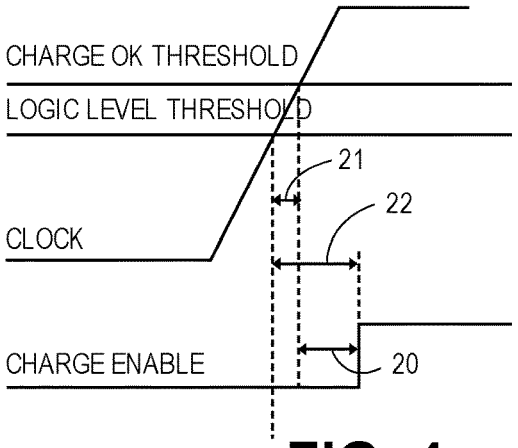
FIG. 4 shows the clock and charge enable waveforms of an embodiment that has both a digital delay circuit and a voltage comparator.

In yet another embodiment, referring now to FIG. 4, the control circuit 10 is configured to produce the charge enable signal 14 such that its assertion is triggered following a predetermined delay 20 after having detected that the clock signal has reached the charge ok threshold. The latter inherently produces the delay 21, such that the total delay 22 in this case is the sum of the two delays 20, 21.

Figure 5:
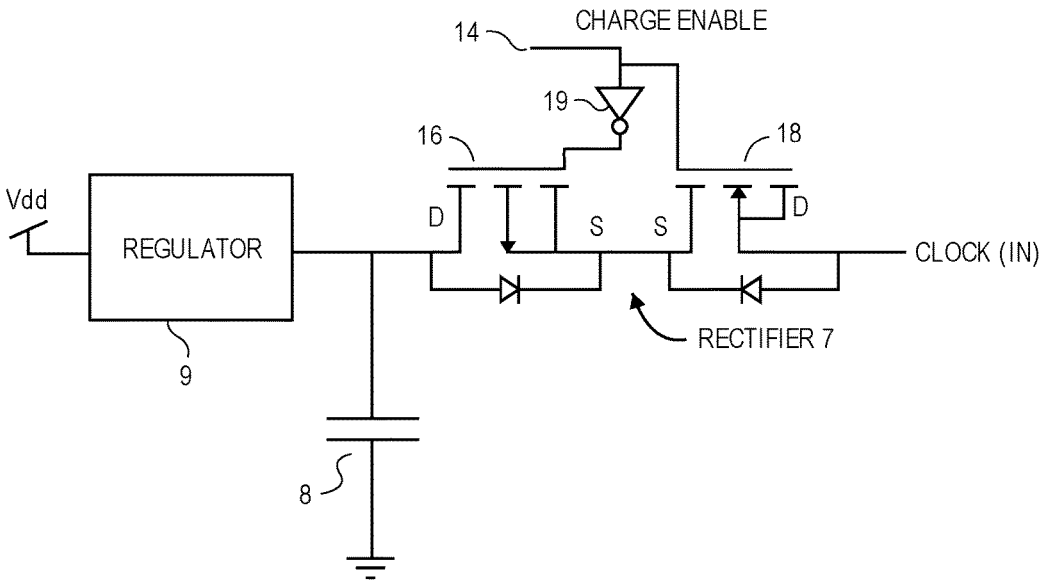
FIG. 5 is a circuit schematic of an example part of the AC-DC power converter.

Turning now to FIG. 5, this is a circuit schematic of an example part of the AC-DC power converter 6, showing examples in particular of the energy store 8 and the rectifier 7. The rectifier 7 in this example includes a switch composed of complimentary field effect transistors 16, 18 that are coupled in series as shown, and whose gate electrodes are driven by the charge enable signal 14 and an inverted version thereof (via an inverter 19). When the charge enable signal 14 is asserted to a high voltage, transistor 18 is turned on, as is transistor 16, where the latter is a P-channel device as opposed to the former which is an N-channel device. The schematic also shows the body diodes of the two transistors 16, 18. When both of these transistors 16, 18 are turned off due to the charge enable signal 14 being de-asserted, the energy store 8 represented as a single capacitor coupled to ground is decoupled from clock (in), such that the charge that is stored in the capacitor does not flow backwards through the switch. As pointed out above, the charge enable signal 14 will be de-asserted during the low phase of the clock signal, such that the switch is turned off (or placed in its open state) during the low phase of the clock signal. Note here that a bypass path may need to be provided that bypasses the switch, from clock (in) to the top plate of the capacitor (energy store 8), for purposes of initial startup of the power converter 6. This bypass path may be provided by another diode (not shown) that directly couples clock (in) to the top plate of the capacitor (energy store 8), to allow for the initial charging of the energy store 8. For the case where the energy store 8 is a capacitor as shown, it may be useful to limit the charging current of the capacitor (during the high phase of the clock signal), where this limiting may be achieved by inherent characteristics of the rectifier 7 or through an additional means such as a series resistor that is placed in series with the capacitor, or by an active current limiting circuit, wherein in both instances the desired result is to limit the charge current of the capacitor.

Still referring to FIG. 5, the voltage regulator 9 may be a low-dropout voltage regulator. A charge pump may also be present (not shown) so as to boost the input voltage to the regulator 9, thereby resulting in Vdd that is higher than the input to the regulator 9, where this may help performance of the analog to digital conversion circuitry or other circuitry that may need a DC voltage, including the transducer 3 itself. Note that the charge pump may be positioned in front of the voltage regulator 9, that is between the voltage regulator 9 and the energy store 8, or it may be placed downstream of the voltage regulator 9. Also, a passive filter may be added, or even in some cases used instead of the voltage regulator 9, to simply filter the DC voltage of the energy store 8.

Figure 6:
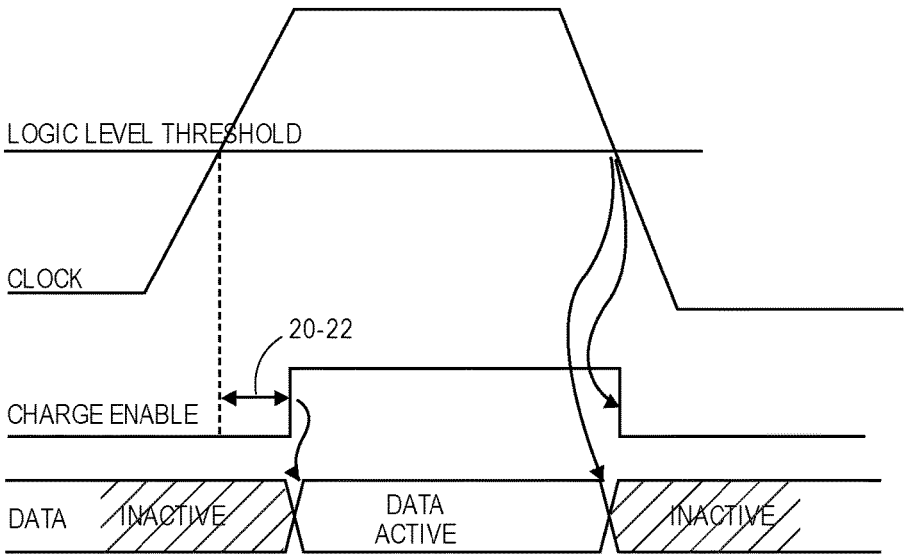
FIG. 6 illustrates example waveforms for the clock, charge enable and data signals.

Turning now to FIG. 6, this figure illustrates example waveforms for the clock, charge enable and data signals in the case where the analog to digital conversion circuit 2 drives its output transducer data bitstream during the high voltage phase but not during the low voltage phase of the clock. As seen in FIG. 6, in this case, the analog to digital conversion circuit 2 that produces the transducer bitstream or data (out), does so during the high voltage phase but not during the low voltage phase, as shown by the "data active" label. Note how in this embodiment, the charge enable signal 14 (produced by the control circuit 10) may be used to delay the start of the data active phase (relative to the clock signal reaching its logic level threshold) by any one of the above described delays 20, 21 or 22. In this manner, the data active phase is assured to not begin until the logic level threshold of the clock signal has propagated and that the clock signal is well within its high voltage phase. In addition, the data active phase ends when the clock signal transitions into its low voltage phase as shown, thereby ensuring that the transducer data bitstream is driven only during the high voltage phase, and not during the low voltage phase of the clock. This aspect is particularly useful where the data line (on which the transducer data bitstream is being driven) has significant capacitance such that some energy would be taken from the energy store 8 to charge the data line during a low to high transition in the data active phase. This significant energy draw can be mitigated, by driving the data line during the high voltage phase portion (also referred to as the active high portion) of the clock as shown in FIG. 6, because in that case the energy needed to charge the data line can be sourced from not just the energy store 8 but also from clock (in), through the rectifier 7. This helps reduce the size of the needed energy store 8, for example reduces the size of the capacitor depicted in FIG. 5.

In another embodiment, an additional delay (similar in function to the control circuit 10 described above) may be provided so as to terminate the replenishment before the falling edge of the clock (rather than at the falling edge of the clock as shown in FIG. 6, where the falling edge immediately triggers de-assertion of the charge enable signal).

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, while FIG. 1 depicts the digital transducer circuit as having four external signal pins, an alternative is to omit the address (in) signal so that only three external pins are needed. Also, while not explicitly shown in FIG. 1, the transducer 3 may need a DC voltage to operate; that power supply voltage can be either derived from Vdd or produced directly from the energy store 8 (by another voltage regulator or charge pump, for example). The description is thus to be regarded as illustrative instead of limiting.

What is claimed is:

1. A digital transducer circuit comprising:

an analog to digital conversion circuit having an input to receive a transducer output signal, and an output that produces a transducer data bitstream, wherein the analog to digital conversion circuit has a latch or flip flop having an input that receives a clock signal; and an AC-DC power converter having a power supply input to receive the clock signal, and a power supply output to produce a DC voltage for use by the analog to digital conversion circuit wherein the AC-DC power converter has a rectifier to rectify the clock signal, an energy store replenished by the rectified clock signal, a voltage regulator, charge pump, or filter to draw power from the energy store and produce the DC voltage, and a control circuit configured to delay replenishment of the energy store by the rectified clock signal, in response to the clock signal.

2. The digital transducer circuit of claim 1 wherein the control circuit comprises a digital delay circuit, and is configured to produce a charge enable signal whose assertion is triggered by a rising edge of the clock signal that is delayed through the digital delay circuit.

3. The digital transducer circuit of claim 1 wherein the control circuit comprises a voltage comparator, and is configured to produce a charge enable signal whose assertion is triggered by the voltage comparator detecting that the clock signal has reached a predetermined voltage threshold.

4. The digital transducer circuit of claim 1 wherein the control circuit is configured to produce a charge enable signal whose assertion is triggered:

by a rising edge of the clock signal as delayed through a digital delay circuit;

by a voltage comparator detecting that the clock signal has reached a predetermined voltage threshold; or following a predetermined delay after having detected that the clock signal has reached a predetermined voltage threshold.

5. The digital transducer circuit of claim 1 wherein the control circuit is configured to produce a charge enable signal that when asserted indicates that the energy store be replenished by the rectified clock signal and when de-asserted indicates that the energy store not be replenished through said power supply input of the AC-DC power converter, and wherein the rectifier comprises a switch that couples the power supply input to the energy store when it is closed in response to assertion of the charge enable signal.

6. The digital transducer circuit of claim 1 wherein the clock signal has a high voltage phase and low voltage phase in each cycle, and the conversion circuit is to drive the transducer bitstream at its output during the high voltage phase and not during the low voltage phase.

7. The digital transducer circuit of claim 6 wherein the clock signal is a square wave.

8. The digital transducer circuit of claim 1 wherein the energy store is replenished by the rectifier during a high phase of the clock signal and not during a low phase of the clock signal, and the rectifier prevents the energy store from depleting, through the power supply input that receives the clock signal, during the low phase of the clock signal.

9. The digital transducer circuit of claim 1 wherein the analog to digital conversion circuit comprises a pulse modulator that translates raw digital values from an analog to digital converter into an output, pulse code modulation or pulse density modulation bitstream.

10. The digital transducer circuit of claim 1 wherein the analog to digital conversion circuit has a further input to receive an external address signal that enables multiple replicates of the transducer circuit to produce each of their respective transducer bitstreams on a single, serial communications bus wire.

11. The digital transducer circuit of claim 1 further comprising a transducer to produce the transducer output signal, wherein the transducer is packaged along with the analog to digital conversion circuit and the AC-DC power converter inside the same integrated circuit package having an external data pin on which the transducer bitstream is produced, an external clock pin on which the clock signal is received, an external ground pin, and no external power supply pin.

12. The digital transducer circuit of claim 11 wherein the integrated circuit package is a 4-pin package and the transducer is an acoustic microphone.

13. A digital transducer circuit comprising:

an analog to digital conversion circuit having an input to receive a transducer output signal, and an output to produce a transducer bitstream using a rising edge of a clock signal;

an AC-DC power converter having a power supply input to receive the clock signal, and a power supply output to produce a DC voltage of the analog to digital conversion circuit, wherein the AC-DC power converter has a rectifier to rectify the clock signal, an energy store replenished by the rectified clock signal, a voltage regulator, charge pump, or filter to draw power from the energy store and produce the DC voltage, and a control circuit configured to delay replenishment of the energy store by the rectified clock signal, until after the rising edge has propagated into the analog to digital conversion circuit.

14. The digital transducer circuit of claim 13 wherein the control circuit comprises a digital delay circuit, and is configured to produce a charge enable signal whose assertion is triggered by a rising edge of the clock signal that is delayed through the digital delay circuit.

15. The digital transducer circuit of claim 13 wherein the control circuit comprises a voltage comparator, and is configured to produce a charge enable signal whose assertion is triggered by the voltage comparator detecting that the clock signal has reached a predetermined voltage threshold.

16. The digital transducer circuit of claim 13 wherein the control circuit is configured to produce a charge enable signal whose assertion is triggered:

by a rising edge of the clock signal as delayed through a digital delay circuit;

by a voltage comparator detecting that the clock signal has reached a predetermined voltage threshold; or following a predetermined delay after having detected that the clock signal has reached a predetermined voltage threshold.

17. The digital transducer circuit of claim 13 wherein the control circuit is configured to produce a charge enable signal that when asserted indicates that the energy store be replenished by the rectified clock signal and when de-asserted indicates that the energy store not be replenished through said power supply input of the AC-DC power converter, and wherein the rectifier comprises a switch that couples the power supply input to the energy store when it is closed in response to assertion of the charge enable signal.

18. The digital transducer circuit of claim 13 wherein the clock signal has a high voltage phase and low voltage phase in each cycle, and the serial port circuit is to drive the transducer bitstream at its output during the high voltage phase and not during the low voltage phase.

19. A method for providing a transducer bitstream, comprising:

converting an analog transducer output signal into a transducer bitstream using one of a rising edge or a falling edge of a clock signal as input to a latch or flip flop of an analog to digital conversion circuit that is performing the conversion;

rectifying the clock signal to produce a rectified clock signal;

replenishing an energy store directly with the rectified clock signal;

drawing power from the energy store to produce a DC voltage of the analog to digital conversion circuit; and controlling the replenishing in each cycle of the clock signal so that replenishment does not start until after a logic level threshold of the clock signal has propagated through the latch or flip flop of the analog to digital conversion circuit.

20. The method of claim 19 wherein controlling the replenishing comprises delaying a rising edge of the clock signal, to trigger the start.

21. The method of claim 19 wherein controlling the replenishing comprises comparing the clock signal to a predetermined voltage threshold, to trigger the start.

22. The method of claim 19 wherein the clock signal has a high voltage phase and low voltage phase in each cycle, the method further comprising driving the transducer bitstream during the high voltage phase and not during the low voltage phase.

* * * * *